US011432077B2

(12) United States Patent
Goekay

(10) Patent No.: US 11,432,077 B2
(45) Date of Patent: Aug. 30, 2022

(54) METHOD FOR TRANSMITTING A HEARING AID SETTING DATA SET FROM A FIRST HEARING AID TO A SECOND HEARING AID, HEARING AID SYSTEM, AND HEARING AID

(71) Applicant: Sivantos Pte. Ltd., Singapore (SG)

(72) Inventor: Umut Goekay, Koenigswinter (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 17/194,486

(22) Filed: Mar. 8, 2021

(65) Prior Publication Data

US 2021/0281957 A1 Sep. 9, 2021

(30) Foreign Application Priority Data

Mar. 6, 2020 (DE) ..... 10 2020 202 915.6

(51) Int. Cl.
*H04R 25/00* (2006.01)

(52) U.S. Cl.
CPC ..... *H04R 25/505* (2013.01); *H04R 25/554* (2013.01); *H04R 25/558* (2013.01); *H04R 2225/55* (2013.01)

(58) Field of Classification Search
CPC ..... H04R 2225/55; H04R 25/505; H04R 25/554; H04R 25/556; H04R 25/558; H04R 25/70
USPC ..... 381/314
See application file for complete search history.

(56) References Cited

U.S. PATENT DOCUMENTS

2018/0352352 A1* 12/2018 Yang ..... H04R 25/505

* cited by examiner

*Primary Examiner* — Phylesha Dabney
(74) *Attorney, Agent, or Firm* — Laurence A. Greenberg; Werner H. Stemer; Ralph E. Locher

(57) ABSTRACT

A method transmits a hearing aid setting data set from a first hearing aid to a second hearing aid. By use of an Internet-capable third device, a translation instruction for translating hearing aid setting data contained in the hearing aid setting data set from a platform of the first hearing aid to a platform of the second hearing aid is retrieved from a database. The translation instruction is transmitted to the first or the second hearing aid or to a local fourth device. By the Internet-capable third device, an instruction for transmitting the hearing aid setting data set is output and the hearing aid setting data set is transmitted locally and while bypassing the Internet or a computer network from the first to the second hearing aid. The hearing aid setting data contained in the hearing aid setting data set are translated in the first or the second hearing aid or in the fourth device without access to the Internet or the computer network to the platform of the second hearing aid.

10 Claims, 1 Drawing Sheet

METHOD FOR TRANSMITTING A HEARING AID SETTING DATA SET FROM A FIRST HEARING AID TO A SECOND HEARING AID, HEARING AID SYSTEM, AND HEARING AID

CROSS-REFERENCE TO RELATED APPLICATION

This application claims the priority, under 35 U.S.C. § 119, of German patent application DE 10 2020 202 915.6, filed Mar. 6, 2020; the prior application is herewith incorporated by reference in its entirety.

BACKGROUND OF THE INVENTION

Field of the Invention

The invention relates to a method for transmitting a hearing aid setting data set from a first hearing aid to a second hearing aid. Furthermore, the invention relates to a hearing aid system. Moreover, the invention relates to a hearing aid.

Hearing aids typically include an output transducer for outputting electrical output signals to the sense of hearing of a user and a signal processor connected upstream for processing input signals into the output signals. In particular in the case of hearing aid devices, hearing aids are used to supply the sense of hearing of persons having impaired sense of hearing. In this case, hearing aids usually include one or more input transducers—usually a respective microphone—for sensing ambient sound. The output transducer is generally a loudspeaker here—also referred to as a "receiver"—for acoustically supplying the sense of hearing. Alternatively, however, it can also be configured as a bone vibrator or cochlear implant for mechanical or electrical stimulation, respectively, of the sense of hearing. The term "hearing aid" is also understood here to include headphones, tinnitus maskers, "wearables", headsets, and the like.

Technical progress and new scientific findings also result in continuous refinement of hearing aids. This applies to both the signal processing algorithms used in the signal processor and also the individual parameters set for hearing aid settings calculated from the audiometric data. These refinements are often taken into consideration in new devices.

Someone who is hard of hearing becomes accustomed to the transmission properties and thus, for example, to the sound of a hearing aid (or a pair of hearing aids) by continuously wearing it or them. If he requires a new device, for example because of worsening of the sense of hearing, he often perceives the unfamiliar sound as foreign and at worst rejects a new hearing aid.

If hearing aid wearers are ready to use a new hearing aid, hearing aid acousticians have heretofore typically attempted to recreate the acoustics of the old hearing aid in the new one (in particular "by hand"), in order to facilitate the changeover. Since modern hearing aids are usually more complex than the one previously used, it is only possible with difficulty in this way to find the best possible setting, in the case of which, on the one hand, the sound of the old hearing aid is recreated and, on the other hand, the advantages of the new hearing aid are still applied.

Detecting the settings of the old hearing aid by way of a computer-supported process upon the supply with a subsequent device and taking them into consideration during the adaptation of the new hearing aid in an initial setting is known from published, European patent application EP 1453358 A1, corresponding to U.S. Pat. No. 7,885,416. The new setting then results from audiometric measurements and in particular the data of the previous hearing aid. The sound of the new hearing aid is thus to be approximated to the old hearing aid.

It is required here either to have the data of the old hearing aid provided or to read these data out of the hearing aid in order to be able to interpret them. Alternatively, the properties of the old hearing aid can also be measured. An acoustic measuring device can be used for this purpose, which places high demands on the acoustic environment, the test signal source, and the acoustic measurement sensor, however.

Determining the settings of an already adapted (old) hearing aid on the basis of a test signal and setting another (new) hearing aid accordingly is known from published, European patent application EP 1416764 A2. The loudspeaker of the new hearing aid is acoustically coupled to the microphone of the old hearing aid and the output of the loudspeaker of the old hearing aid is recorded and evaluated by a separate measuring microphone.

BRIEF SUMMARY OF THE INVENTION

The invention is based on the object of simplifying the adaptation of a subsequent device in hearing aids.

This object is achieved according to the invention by a method having the features of the independent method claim. Furthermore, this object is achieved according to the invention by a hearing aid system having the features of the independent hearing aid system claim. Moreover, this object is achieved according to the invention by a hearing aid having the features of the independent hearing aid claim. Advantageous embodiments and refinements of the invention, which are partially inventive per se, are described in the dependent claims and the following description.

The method according to the invention is used for transmitting a hearing aid setting data set from the first hearing aid to a second hearing aid. According to the method, a translation instruction for hearing aid setting data contained in the hearing aid setting data set from a platform of the first hearing aid to a platform of the second hearing aid is retrieved from a database by means of an Internet-capable third device. The translation instruction is subsequently transmitted by this third device to the first of the second hearing aid or to a local fourth device. In addition, an instruction for the transmission of the hearing aid setting data set is output by means of the Internet-capable third device. In particular on the basis of this instruction, the hearing aid setting data set is transmitted locally and while bypassing the Internet or a computer network from the first to the second hearing aid. The hearing aid setting data contained in the hearing aid setting data set are additionally translated in the first or the second hearing aid or in the fourth device, without access to the Internet or the computer network, to the platform of the second hearing aid.

In other words, by means of the third device, the translation instruction is retrieved and the transmission of the hearing aid setting data set from the first to the second hearing aid is initiated (or also: "triggered"). The translation takes place here on the basis of the translation instruction in the first hearing aid—i.e., before the transmission—or the second hearing aid—i.e., after the transmission—or also in the fourth device, which is preferably used in this case as a type of mediation point during the transmission of the hearing aid setting data set.

The first hearing aid is preferably an "old" hearing aid to be replaced, preferably a hearing assistance device. The second hearing aid is in particular a new, preferably further developed hearing aid, in particular a hearing assistance device which is to replace the first hearing aid.

The above-described method has the advantage that the transmission of "old" hearing aid setting data from an old to a new hearing aid can be simplified and in particular can be carried out independently of an audiologist. Moreover, the method is comparatively resource-preserving, in particular with regard to a data transmission rate available for Internet usage or data transmission via an existing computer network, because only the translation instruction has to be transferred via a data connection from another location (at which the above-described database is located). Moreover, this method is also particularly secure with regard to data security of personal data, since data which have reference to a person—namely the hearing aid settings themselves—are not transmitted via a data path which enables the access of third parties comparatively easily.

The term "platform" is understood here and hereinafter in particular as the construction of a hearing aid at least with respect to its processing architecture, i.e., for example the chipset used (independently of whether a microprocessor or an integrated circuit, in particular an "ASIC" is used) and/or the processing models used (in particular the formulation of signal processing algorithms, and the programming structure and/or language used). Additionally or alternatively, however, this is also understood as the "geometric" and/or electronic construction of the hearing aid, for example the type and/or the distance of multiple microphones in relation to one another, the type of a loudspeaker, and the like. The properties related to the above-mentioned features are generally reflected in a transmission characteristic different for each hearing aid model.

The term "translation instruction" is understood here and hereinafter in particular as a set of conversion rules (or: functions), by means of which setting data (also referred to as parameters), in particular their values, by means of which the transmission characteristic of the respective hearing aid with respect to a user-specific transmission behavior can be influenced, can be converted to the corresponding other platform.

The third device is preferably a smartphone, a computer (PC or laptop), or the like, on which a control application for determining the translation instruction and for triggering the transmission of the hearing aid setting data set is implemented.

In one preferred method variant, the translated hearing aid setting data contained in the hearing aid setting data set are used by the second hearing aid as (in particular "new") setting data for an assigned signal processor (i.e., included in the second hearing aid). In other words, the original hearing aid settings of the old hearing aid, in particular its transmission behavior, are thus overwritten on the new hearing aid.

In one expedient method variant, the hearing aid setting data set is transmitted from the first hearing aid directly to the second hearing aid. In this case, the first hearing aid is thus configured for data transmission and the second at least for data reception. For example, the data transmission takes place by means of a radio connection, in particular according to the Bluetooth standard or by means of a peer-to-peer WLAN connection, by means of a magnetic-inductive connection (also referred to as a "MI link"), or by means of an ARC (audio return channel) connection.

In an alternative method variant, a wired data transmission is used.

In one expedient method variant, the instruction (from the third device) to transmit the hearing aid setting data set is output to the second hearing aid.

In particular, the third device firstly establishes a connection to the first hearing aid. It preferably subsequently creates a key on the basis of at least one unique identifier of the first hearing aid and stores it in particular in a memory of the first hearing aid. The third device then preferably establishes a connection to the second hearing aid and transmits this key to the second hearing aid. The third device preferably uses the MAC address and/or a serial number of the first hearing aid as the unique identifier. The third device preferably also generates a random variable which is also incorporated in the creation of the key. The security of the key can thus be increased.

In one expedient method variant, the third device firstly determines the respective type of the first and the second hearing aid to retrieve the translation instruction. The third device preferably transmits these two types to the database and receives the corresponding translation instruction therefrom.

The translation instruction is preferably transmitted (by the third device) to the second hearing aid. This is advantageous in that comparatively new hearing aids also have a comparatively high-performance processing core.

In the method variant in which the hearing aid setting data set is transmitted to the local fourth device and translated thereby, a charging device compatible with the first and the second hearing aid—i.e., in particular used for charging—is used as the local fourth device. This charging device preferably includes a controller having an assigned data memory. The hearing aid setting data set is preferably transmitted in this case from the first hearing aid to the fourth device, translated thereon, preferably on the basis of the translation instruction, and subsequently transmitted therefrom to the second hearing aid.

The hearing aid system according to the invention includes the above-mentioned database and the above-mentioned third device, wherein a translation instruction for hearing aid setting data contained in a hearing aid setting data set from the platform of the first hearing aid to the platform of the second hearing aid is stored on the database. The third device is configured in the context of the hearing aid system, in the context of a transmission of the hearing aid setting data set from the first of the second hearing aid, to retrieve the translation instruction from the database and to transmit it to the first or second hearing aid or to the local fourth device.

The hearing aid system is therefore configured and provided to carry out the above-described method—independently or in cooperation with the user of the first and the second hearing aid, optionally also with technicians.

The database is preferably operated by the producer of at least the second hearing aid and contains a large number of translation instructions for hearing aid setting data between a large number of hearing aids, in particular from comparatively "old" hearing aid models to correspondingly newer hearing aid models.

Optionally at least the second hearing aid, furthermore optionally also the first hearing aid at least while the method is being carried out, forms a part of the hearing aid system.

The hearing aid according to the invention includes a controller (also: signal processor), which is configured to process input signals on the basis of user-specific hearing aid setting data to form output signals. Moreover, the hearing aid according to the invention includes a receiving interface for receiving the hearing aid setting data in the context of a hearing aid setting data set from another (in particular the first) hearing aid and for receiving the translation instruction. The controller is (or will be after receiving the translation instruction) additionally configured by means of the translation instruction to translate the hearing aid setting data contained in the hearing aid setting data set received from the other hearing aid from the platform of the other hearing aid to its own platform.

In an optional variant, the hearing aid is formed by a pair of hearing aids operating in a binaural manner. These are therefore configured to jointly supply the sense of hearing of the user of these two hearing aids while exchanging signals with one another. Binaural hearing aids differ from two hearing aids used separately from one another and independent from one another, by means of which each ear is supplied as such, in particular due to the above-mentioned signal exchange. For example, a setting of a directional effect is carried out on the basis of a linkage of sound signals received at hearing aids worn on the right and left, typically via wireless transmission between the two hearing aids, and offsetting of the signals frequently takes place in one of the two hearing aids. In the case of two binaural hearing aids, the hearing aid setting data set is preferably only transmitted to one of the two hearing aids, optionally translated therein on the basis of the transmission instruction to the corresponding platform, and subsequently the hearing aid setting data set already adapted to the new hearing aid is preferably transmitted automatically to the other binaural hearing aid. This is simpler for the user of the binaural hearing aid pair, since he does not have to initiate the transmission process twice.

The conjunction "and/or" is to be understood here and hereinafter in particular in such a way that the features linked by means of this conjunction can be formed both jointly and also as alternatives to one another.

Other features which are considered as characteristic for the invention are set forth in the appended claims.

Although the invention is illustrated and described herein as embodied in method for transmitting a hearing aid setting data set from a first hearing aid to a second hearing aid, hearing aid system, and hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Parts corresponding to one another are always provided with the same reference signs in all figures.

Figure 1:
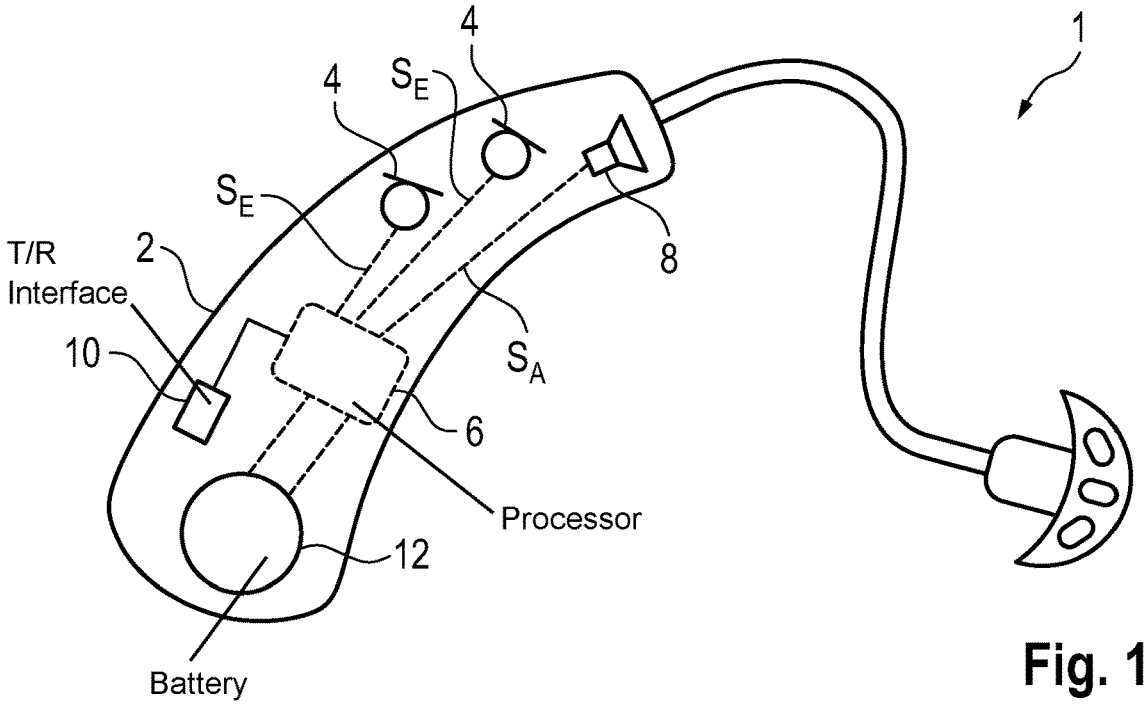
FIG. 1 is an illustration showing a hearing aid in a schematic illustration.

Referring now to the figures of the drawings in detail and first, particularly to FIG. 1 thereof, there is shown a hearing aid 1, which forms a hearing assistance device for persons impaired in their sense of hearing ("hard of hearing"). The hearing aid 1 includes a housing 2, in which multiple electrical components of the hearing aid 1 are arranged. In the present exemplary embodiment, these are two microphones 4 for sensing ambient sound, a signal processor 6 (also: "controller") for processing the input signals SE generated by means of the microphones 4 upon sensing ambient sound, and a loudspeaker 8 for acoustically outputting output signals SA generated by means of the signal processor 6 from the input signals SE. As further electrical components, the hearing aid 1 contains a transmitting and receiving device 10 (also: transmitting and receiving interface) for data transmission with other devices, for example another hearing aid (for example in the case of a binaural hearing system) and/or a third device. A battery 12 for the power supply of the other electrical components also forms an electrical component. The battery 12 is formed in the present exemplary embodiment by a rechargeable battery. However, the battery 12 can alternatively also be formed by a "primary cell", i.e., a non-rechargeable cell.

One or more signal processing algorithms are implemented in the signal processor 6, which enable user-specific and preferably also situation-dependent signal processing. The hearing aid 1 can be adapted here by appropriate parameterization of the respective signal processing algorithm to a specific user. The transmission behavior of the hearing aid 1 is thus adapted to the requirements, for example to the hearing loss, and in particular also to personal preferences of the respective user.

Figure 2:
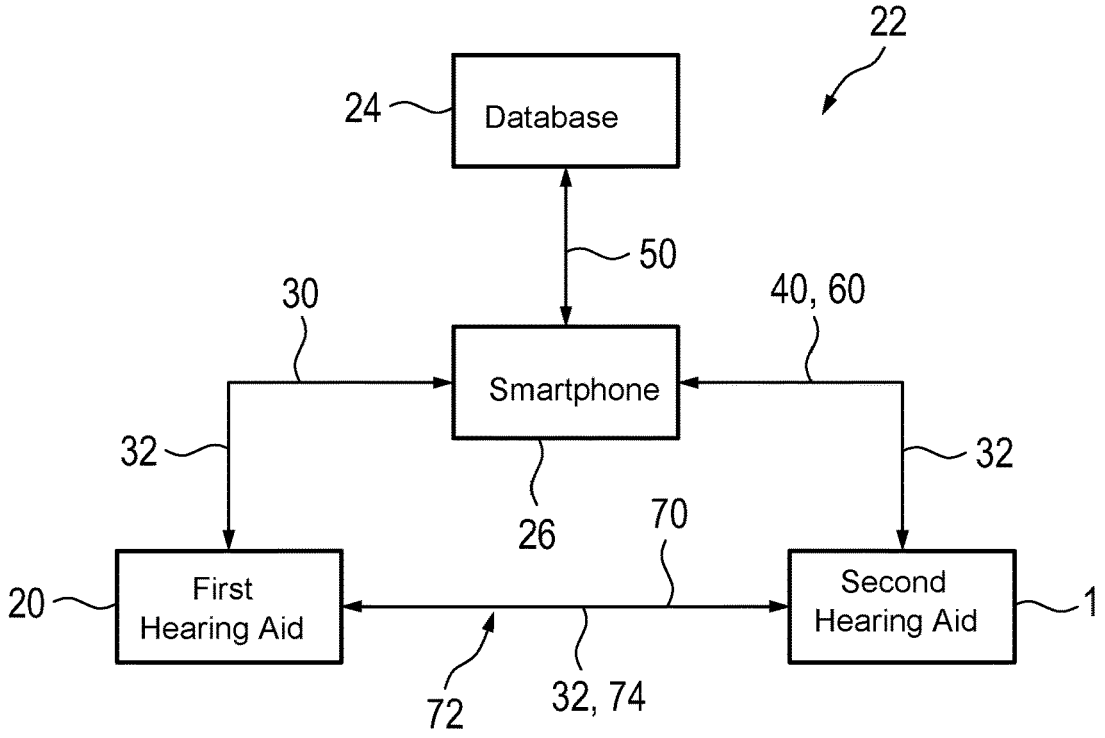
FIG. 2 is a block diagram of hearing aid system and a method executed thereby.

For the case in which the user of an old "first" hearing aid 20 (see FIG. 2) will not continue to use this hearing aid, specifically because in the future he will use a newer, "second" hearing aid, the above-described hearing aid 1 here, it is of interest for the user to be able to transmit the transmission behavior of the old hearing aid 20 to the new hearing aid 1. This is regularly the case due to familiarity with the transmission behavior up to this point. For such a transmission, a hearing aid system 22 is specified. It contains a database 24 (also referred to as an "online service"), on which translation instructions for translating hearing aid setting data from platforms of old hearing aids to platforms of newer hearing aids, specifically thus also a translation instruction of the hearing aid setting data of the old hearing aid 20 to the platform of the new hearing aid 1, are stored. The hearing aid system 22 also contains a third device, in the present exemplary embodiment in the form of a smartphone 26, on which a software application for carrying out at least a part of a method described in greater detail hereinafter is implemented.

At least the new hearing aid 1 also forms a part of the hearing aid system 22. The old hearing aid 22 can also be considered to be part of the hearing aid system 22 at least for the duration of the method described hereinafter.

In order to initiate the transmission of hearing aid setting data, by means of which the transmission behavior of the old hearing aid 20 is specified, the user starts the application implemented on the smartphone 26. The smartphone 26 thereupon connects in a first method step 30 to the old hearing aid 22, which therefore also includes a communication unit for implementing a transmission channel—optionally wired, but preferably wireless. The smartphone 26 queries a unique identifier, in one exemplary embodiment specifically the serial number, from the old hearing aid 22. In further exemplary embodiments, the smartphone 26 alternatively or additionally queries the MAC address of the old hearing aid 20. On the basis of the identifier (or the identifiers), the smartphone 26 creates a key 32 and stores it in a memory of the old hearing aid 20. In addition, the smartphone 26 queries the model of the old hearing aid 20.

Subsequently, the smartphone 26 closes the connection to the old hearing aid 20 and in a second method step 40 connects to the new hearing aid 1 and queries its model from it. In addition, the smartphone 26 transmits the key 32 to the new hearing aid 1.

In a further method step 50, the smartphone 26 (optionally in parallel to the connection to the new hearing aid 1) connects via a network, specifically the Internet, to the database 24. From the database 24, the smartphone 26 retrieves the transmission instruction assigned to the two hearing aids 1 and 20, specifically the two models, for the hearing aid setting data from the old platform to the new platform.

The smartphone 26 transmits this translation instruction to the new hearing aid 1 in a method step 60. In an optional variant, the smartphone 26 only now transmits the key 32 to the new hearing aid 1. In addition, the smartphone 26 queries the readiness of the new hearing aid 1 to receive the hearing aid setting data. This exists in particular as soon the translation instruction and the key 32 are stored in the new hearing aid 1. If the new hearing aid 1 reports its readiness, the smartphone 26 outputs an instruction to the new hearing aid 1 to begin the data transmission. The new hearing aid 1 thereupon searches in a method step 70 for the old hearing aid 20 on the basis of the key 32 and establishes a direct communication connection 72 with it. The old hearing aid 20 authenticates the new hearing aid 1 in this case in that it communicates the key 32 to the old hearing aid 20. The old hearing aid 20 thereupon starts the transmission of the hearing aid setting data in the form of a hearing aid setting data set 74.

The communication connection 72 is, for example a signal connection based on an inductive signal transmission. The Internet or another computer network is not used during the data transmission between the hearing aids 1 and 20.

As soon the new hearing aid 1 has completely received the hearing aid setting data set 74, in a further method step (not shown in greater detail), the new hearing aid 1 calculates the hearing aid setting data corresponding to its platform on the basis of the translation instruction from the hearing aid setting data of the old hearing aid 20 and stores these data in its memory as parameters (setting data) for its signal processing algorithms.

In an exemplary embodiment not shown in greater detail, a local (i.e., provided at the user) fourth device in the form of a charging device for the hearing aids 1 and 20 is connected between the two hearing aids 1 and 20. The charging device includes a controller and an assigned memory, to which the smartphone 26 transmits the translation instruction. The transmission of the hearing aid setting data set 74 takes place here in that the old hearing aid 20 is coupled to the charging device, firstly to the charging device. The charging device subsequently carries out the conversion of the hearing aid setting data to the platform of the new hearing aid 1 and transmits the "converted" hearing aid setting data set 74 to the new hearing aid 1, as soon as it is coupled to the charging device.

The subject matter of the invention is not restricted to the above-described exemplary embodiments. Rather, further embodiments of the invention can be derived by a person skilled in the art from the above description. In particular, the individual features of the invention described on the basis of the various exemplary embodiments and their design variants can also be combined with one another in another way.

LIST OF REFERENCE SIGNS

1 hearing aid
2 housing
4 microphone
6 signal processor
8 loudspeaker
10 transmitting and receiving device
12 battery
20 hearing aid
22 hearing aid system
24 database
26 smartphone
30 method step
32 key
40 method step
50 method step
60 method step
70 method step
72 communication connection
74 hearing aid setting data set
SE input signal
SA output signal

The invention claimed is:

1. A method for transmitting a hearing aid setting data set from a first hearing aid to a second hearing aid, which comprises the steps of:

retrieving from a database, by means of an Internet-capable third device, a translation instruction for translating hearing aid setting data contained in the hearing aid setting data set from a platform of the first hearing aid to a platform of the second hearing aid;

transmitting the translation instruction to the first or the second hearing aid or to a local fourth device;

outputting, by means of the Internet-capable third device, an instruction for transmitting the hearing aid setting data set;

transmitting the hearing aid setting data set locally and while by-passing the Internet or a computer network from the first to the second hearing aid; and translating the hearing aid setting data contained in the hearing aid setting data set in the first or the second hearing aid or in the local fourth device without access to the Internet or the computer network to the platform of the second hearing aid.

2. The method according to claim 1, wherein the hearing aid setting data which are contained in the hearing aid setting data set and are translated are used by the second hearing aid as setting data for a signal processor.

3. The method according to claim 1, which further comprises transmitting the hearing aid setting data set from the first hearing aid directly to the second hearing aid.

4. The method according to claim 1, wherein the instruction to transmit the hearing aid setting data set is output to the second hearing aid.

5. The method according to claim 4, wherein the Internet-capable third device creates a key on a basis of at least one unique identifier of the first hearing aid, stores the key in a memory of the first hearing aid, and subsequently transmits the key to the second hearing aid.

6. The method according to claim 1, wherein the Internet-capable third device determines a respective type of the first and the second hearing aid to retrieve the translation instruction.

7. The method according to claim 1, which further comprises transmitting the translation instruction to the second hearing aid.

8. The method according to claim 1, wherein a charging device compatible with the first and the second hearing aid is used as the local fourth device, the charging device includes a controller having an assigned data memory, and wherein the hearing aid setting data set is transmitted from the first hearing aid to the local fourth device and therefrom to the second hearing aid.

9. A hearing aid system, comprising:

a first hearing aid;

a second hearing aid;

a third device;

a database storing a translation instruction for translating hearing aid setting data contained in a hearing aid setting data set from a platform of said first hearing aid to a platform of a second hearing aid; and said third device being configured in a context of a transmission of the hearing aid setting data set from said first hearing aid to said second hearing aid, to retrieve the translation instruction from said database and to transmit the translation instruction to said first hearing aid or said second hearing aid or to a local fourth device.

10. A hearing aid, comprising:

a controller configured to process input signals on a basis of user-specific hearing aid setting data to form output signals; and a receiving interface for receiving the hearing aid setting data in a context of a hearing aid setting data set from another hearing aid and for receiving a translation instruction, wherein said controller is configured by means of the translation instruction to translate the hearing aid setting data contained in the hearing aid setting data set received from the other hearing aid from a platform of the other hearing aid to its own platform.

* * * * *